US005196209A

United States Patent [19]

Schimpff

[11] Patent Number: 5,196,209

[45] Date of Patent: Mar. 23, 1993

[54] MAKING A PRESTRESSED CONCRETE BEAM

[75] Inventor: Frithjof Schimpff, Wiesbaden, Fed. Rep. of Germany

[73] Assignee: Wayss & Freytag AG, Frankfurt a.M., Fed. Rep. of Germany

[21] Appl. No.: 641,157

[22] Filed: Jan. 14, 1991

[30] Foreign Application Priority Data

Jan. 12, 1990 [DE] Fed. Rep. of Germany ..... 4000729

[51] Int. Cl.[5] ..... B28B 23/06

[52] U.S. Cl. ..... 425/111; 249/46; 249/97; 249/219.1; 264/228; 264/229

[58] Field of Search ..... 425/111, DIG. 22; 249/43, 40, 86, 97, 190, 215, 219.1, 167; 264/228, 229

[56] References Cited

U.S. PATENT DOCUMENTS

| | | | |
|---|---|---|---|
| 2,655,708 | 10/1953 | Eschenbrenner | 425/111 |
| 2,867,884 | 1/1959 | Brandt | 425/111 |
| 3,236,486 | 2/1966 | Allen | 249/40 |
| 3,427,772 | 2/1969 | Williams | 52/223 |
| 3,462,106 | 8/1968 | Buyken | 425/111 |
| 3,583,047 | 6/1971 | Uchiyama | 425/111 |
| 3,734,453 | 5/1973 | Bailey | 249/40 |
| 3,962,786 | 6/1976 | Mori et al. | 30/168 |
| 4,421,710 | 12/1983 | Borcoman | 249/86 |

FOREIGN PATENT DOCUMENTS

| | | |
|---|---|---|
| 54279 | 10/1974 | Australia . |
| 578768 | 6/1933 | Fed. Rep. of Germany . |
| 3931201 | 11/1990 | Fed. Rep. of Germany . |
| 1528919 | 5/1968 | France . |
| 2230807 | 5/1974 | France . |
| 751631 | 7/1956 | United Kingdom . |

*Primary Examiner*—Jay H. Woo
*Assistant Examiner*—Khanh P. Nguyen
*Attorney, Agent, or Firm*—Herbert Dubno; Andrew Wilford

[57] ABSTRACT

A prestressed concrete beam is made by first fitting the opposite ends of a group of reinforcing rods through respective holes in a pair of longitudinally spaced end plates having longitudinally confronting inner faces and opposite outer faces, then providing on each of the rods a head bearing longitudinally inward on the respective outer face, and then applying opposite outward traction to the end plates to tension the rods and filling around the rods and between the inner faces of the plates with a mass of concrete. The concrete mass is then cured and the traction on the end plates is released. Subsequently the heads of the rods are released from the plates and the plates are removed from the ends of the mass of cured concrete. The heads can be machined or burnt off, or the plate can be constructed to release them.

4 Claims, 12 Drawing Sheets

MAKING A PRESTRESSED CONCRETE BEAM

FIELD OF THE INVENTION

The present invention relates to a concrete beam. More particularly this invention concerns a method of and apparatus for making such a beam.

BACKGROUND OF THE INVENTION

A standard prestressed concrete beam comprises an elongated body of concrete in which is imbedded a plurality of longitudinally extending and normally throughgoing prestressing members that are normally under tension. The members are typically steel rods in the form of wires or cables.

One standard method of making such a beam entails fitting the rods through an elongated upwardly open form with the ends of the rods projecting from the ends of the form. Nuts or other traction elements are applied to the projecting ends and are tightened to put the rods under tension. The form is then filled with concrete which is screeded off level with its rim, and the mass is allowed to cure. Once sufficiently hard, the traction elements are released and the thus formed beam is demolded and the rods are cut off flush with the end of the form. Alternately the rods can end short of the end of the form and be held by releasable traction elements so as not to project past the form end. In this system, which is described in German utility model 1,833,644, ribbed reinforcement rods are used so that they bond along their full lengths to the surrounding concrete and, as a result, the tension in the rods is transferred to the entire beam.

This system has the disadvantage that only a limited number of rods can normally be clamped due to the space occupied by the traction nuts, so that certain types of heavy-duty beams cannot be produced. Furthermore the beam must remain in the mold until it is fully cured, otherwise the rod will retract and separate from the surrounding concrete.

In another known method described in German utility model 1,744,448 the group of rods is fitted through a pair of plates formed with an array of holes each receiving and slightly larger than the respective rod. The plates are arranged at the ends of the group of rods and the rods are formed with heads that bear inward against the plate. This assembly of rods and plates is set in the mold and each plate is attached to a traction element that extends through the end wall of the mold, traction is applied to tension the rods, and the mold is filled with concrete. When the concrete has substantially cured, the traction elements, which can be simple bolts threaded into the plates, are withdrawn and the beam is demolded. Such a system can use relatively smooth reinforcing rods as the prestress force is not transmitted to the concrete as much by adherence of the concrete to the reinforcement rods as by the plates in which the headed ends of the rods are seated.

The main disadvantage of this system is that the anchor plates must remain in the finished beam. This plate represents a not negligible cost that is reflected in the price of the finished product. When same is a mass-produced item like a railway sleeper, the additional cost of these anchor plates adds noticeably to the price.

OBJECTS OF THE INVENTION

It is therefore an object of the present invention to provide an improved system for making prestressed concrete beams.

Another object is the provision of such a improved system for making prestressed concrete beams which overcomes the above-given disadvantages, that is which is simple yet which allows a beam to be made at very low cost.

SUMMARY OF THE INVENTION

A prestressed concrete beam according to the invention is made by first fitting the opposite ends of a group of reinforcing rods through respective holes in a pair of longitudinally spaced end plates having longitudinally confronting inner faces and opposite outer faces, then providing on each of the rods a head bearing longitudinally inward on the respective outer face, and then applying opposite outward traction to the end plates to tension the rods and filling around the rods and between the inner faces of the plates with a mass of concrete. The concrete mass is then cured and the traction on the end plates is released. Subsequently according to this invention the heads of the rods are released from the plates and the plates are removed from the ends of the mass of cured concrete.

With this system, therefore, the plates are not left in the beam or other structural member thus produced. Since the anchor plate is reusable, ribbed reinforcement bars are used as the prestressing rods. The advantage is clearly that virtually any number of rods can be used, as there is no need to provide individual pulling heads at each end of each rod.

According to the invention the heads of the rods are provided on the rods by forming them rivet-fashion unitarily therewith and these heads are released from the plates by removing them outward of the respective outer faces. This removal can be by machining them off or by burning them off with an electric arc. They can also be chiseled off, in Which case a special crosswise passage can be formed in the anchor plate to accommodate the chisel.

Alternately according to this invention after applying traction to the rods and before filling around the tensioned rods with concrete the inner face of each plate is provided with a compressible body, and after releasing the traction and before releasing the heads the plates are pressed inward so as to inwardly compress the respective bodies so the heads project outward from the plates. This makes removal of the heads fairly simple.

It is also possible according to this invention to make the holes keyhole shaped so that while traction is applied the heads are engaged in narrow-width portions of the respective holes. The heads are released by shifting the plates so that wide-width portions of the holes align with the respective heads and same can pass longitudinally therethrough.

The apparatus for carrying out this invention therefore has means for releasing the heads of the rods from the plates so that the plates can be removed from the ends of the mass of cured concrete.

In a very simple embodiment each of the heads is a nut and the means is formed by interengaging screwthreads between the nut and the respective end of the rod.

Alternately the means is constituted by a keyhole shape of the holes of the plate. The keyhole-shaped holes have a large end through which the respective rod head can pass and a narrow end through which it cannot. The keyhole-shaped holes can extend along a common circle or can extend parallel to each other.

It is also possible according to the invention for the holes to each be sufficiently wide that the respective heads can move freely therethrough. In this case the means is constituted a respective multipart plugs wedged in the holes inward of the respective heads. The plugs can be of inwardly tapering shape with springs urging their parts apart. The plugs and the respective holes can also have complementary part-spherical surfaces engaging each other.

Similarly according to the invention when the holes are each sufficiently wide that the respective heads can move freely therethrough the means can be respective clips shaped with notches engaging around the respective rods inward of the respective heads and lying against the respective outer faces.

The plate can be formed on its inner face at each hole with an inwardly projecting boss so that the heads are retained at a level inward of the respective inner faces. Thus when the heads are removed, nothing is left projecting from the end of the beam.

To prevent the plates from wedging in the mold, they can be of trapezoidal shape seen from the end and/or from above.

Finally it is within the scope of this invention for the plate to be formed with at least one passage into which at least one of the holes opens. In this case the means is a tube rotatable in the passage and formed with a keyhole-shaped hole through which the respective head can engage to trap same in the passage.

BRIEF DESCRIPTION OF THE DRAWINGS

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
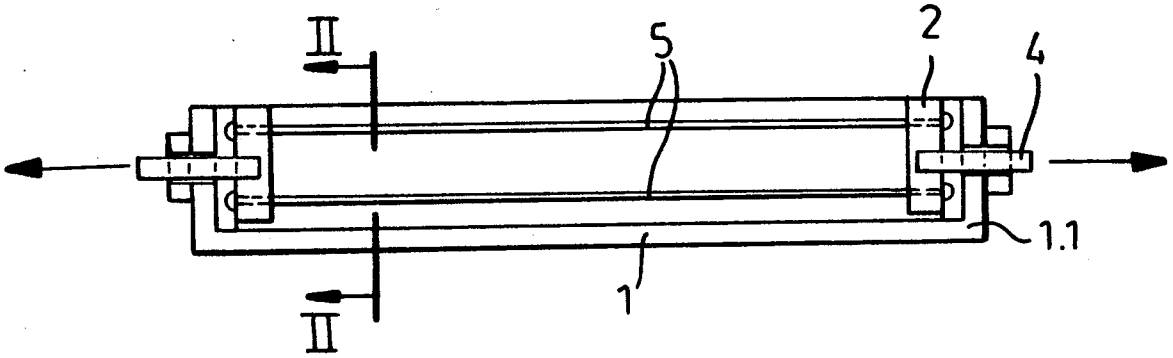
FIG. 1 is a small-scale top view illustrating the method of this invention.
Figure 3:
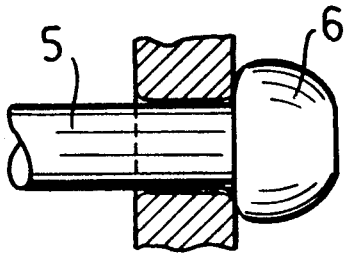
FIG. 3 is a large-scale sectional view of a detail of FIG. 1.
Figure 2:
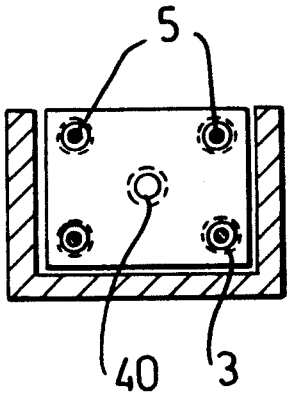
FIG. 2 is a section taken along line II—II of FIG. 1.

As seen in FIGS. 1 through 3 a mold 1 having longitudinally extending side and bottom walls and transversely extending end walls is used to form a concrete beam. Rods 5, which can be wires, pass through holes 3 in rectangular end plates 2 each formed with a central threaded hole 40. The ends of the rods 5 are upset to have rivet-like heads 6 that lie against the outer faces of the plates 2. Tension elements 4 in the form of standard bolt 4 and nuts are threaded into the holes 40 and braced against the end walls of the mold 1. This action longitudinally tensions the rods 5.

Then a mass 7 (see FIG. 4) of concrete is filled into the mold 1 around the rods 5 and between the inner faces of the plates 2, and this mass is allowed to cure. Once it is cured the traction elements 4 are screwed out and the intermediate product comprised of the mass 7 with the rods 5 and plates 2 is demolded. Then according to this invention the plates 2 are released from the rods 5 and recovered.

Figure 4:
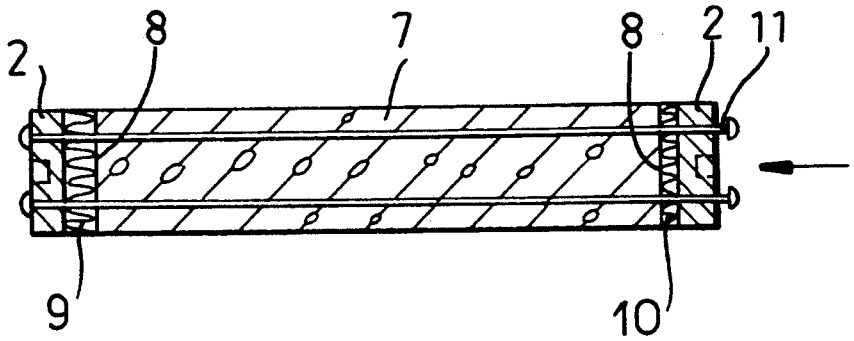
FIG. 4 is a view like FIG. 1 showing an alternative system according to the invention.

It is possible as seen in FIG. 4 to ease the job of removing the plates 2 by providing on the inner face 8 of each plate 2 a compressible intermediate body 9 or a compressible layer 10. Thus as shown to the right in FIG. 4, the plate 2 can be pressed inward to compress the body 9 or 10 against the end of the cured mass 7 and to make the heads 6 project outward as indicated at 11. Sawing or clipping off the heads 6 when they stand proud like this is a relatively easy job.

Figure 5:
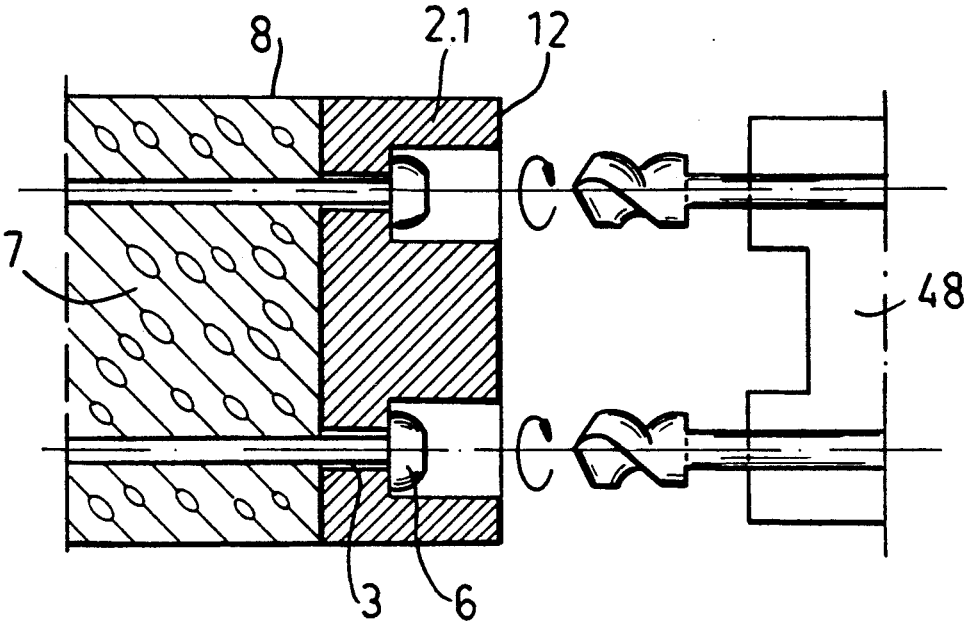

FIG. 5 shows how the heads 6 can be machined off by a drilling apparatus 48. In this case the plate 2.1 has an outer face 12 and the bores 3 are stepped counterbores with the heads actually braced against shoulders of the bores.

Figure 6:
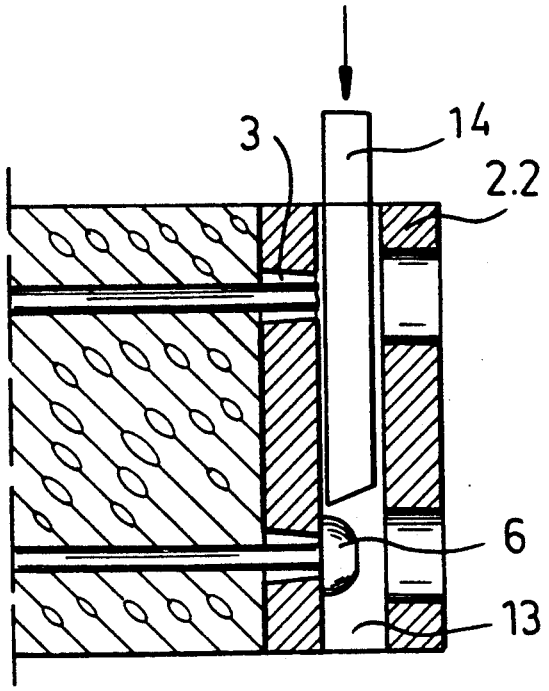

FIG. 6 illustrates an anchor plate 2.2 formed with a crosswise passage 13 crossing the holes 3 and permitting a chisel 14 to be driven through it to shear off the rod heads 6.

Figure 7:
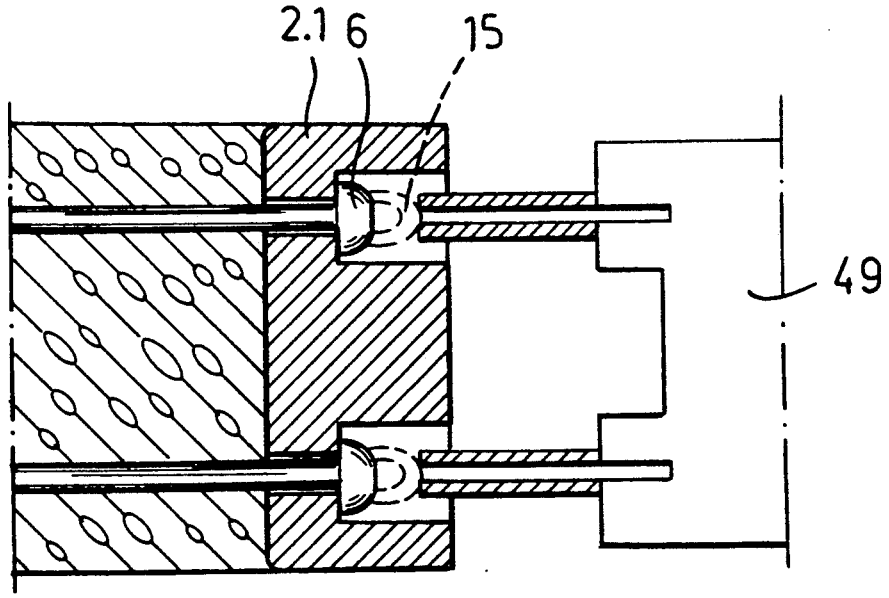
FIGS. 5, 6, and 7 are largely diagrammatic sectional side views illustrating three ways of carrying out the method of this invention.

In FIG. 7 a plate 2.1 identical to that of FIG. 5 is used, but the heads 6 are burnt off via an electric or gas-type welding device 49.

Figure 8:
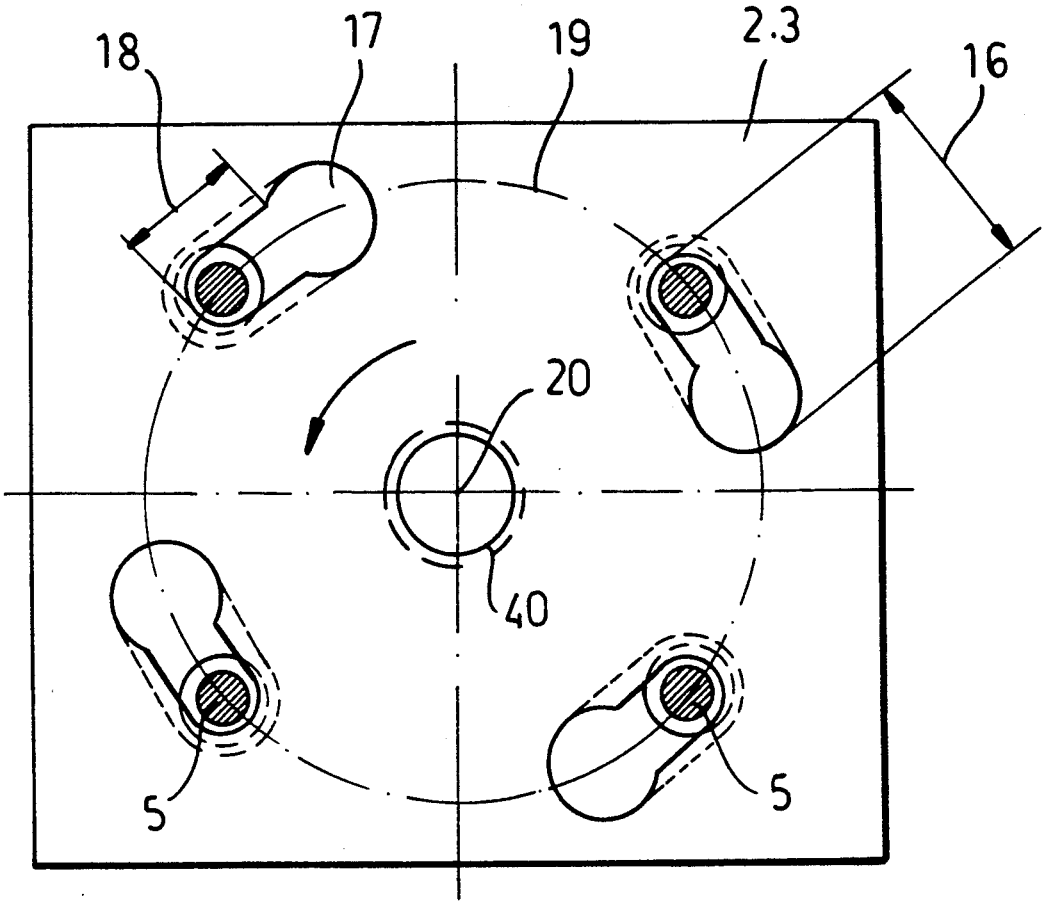
FIGS. 8, 9, and 10 are end views of three different anchor plates according to the invention.

The plate 2.3 of FIG. 8 is formed with four keyhole-shaped holes 16 each having a wide part 17 and a narrow part 18. The holes 16 extend along or are tangent to a circle 19 having a center 20 at the middle of the center hole 40. While traction is initially applied and until the mass 7 is cured the rods 5 are seated as illustrated in the narrow parts 18. Once the mass 7 is cured and the plates 2.3 are to be recovered, they are twisted about the center 20 as illustrated by the arrow to align the heads with the wide parts 17. The plate 2.3 can then be pulled longitudinally off the structure.

Figure 9:
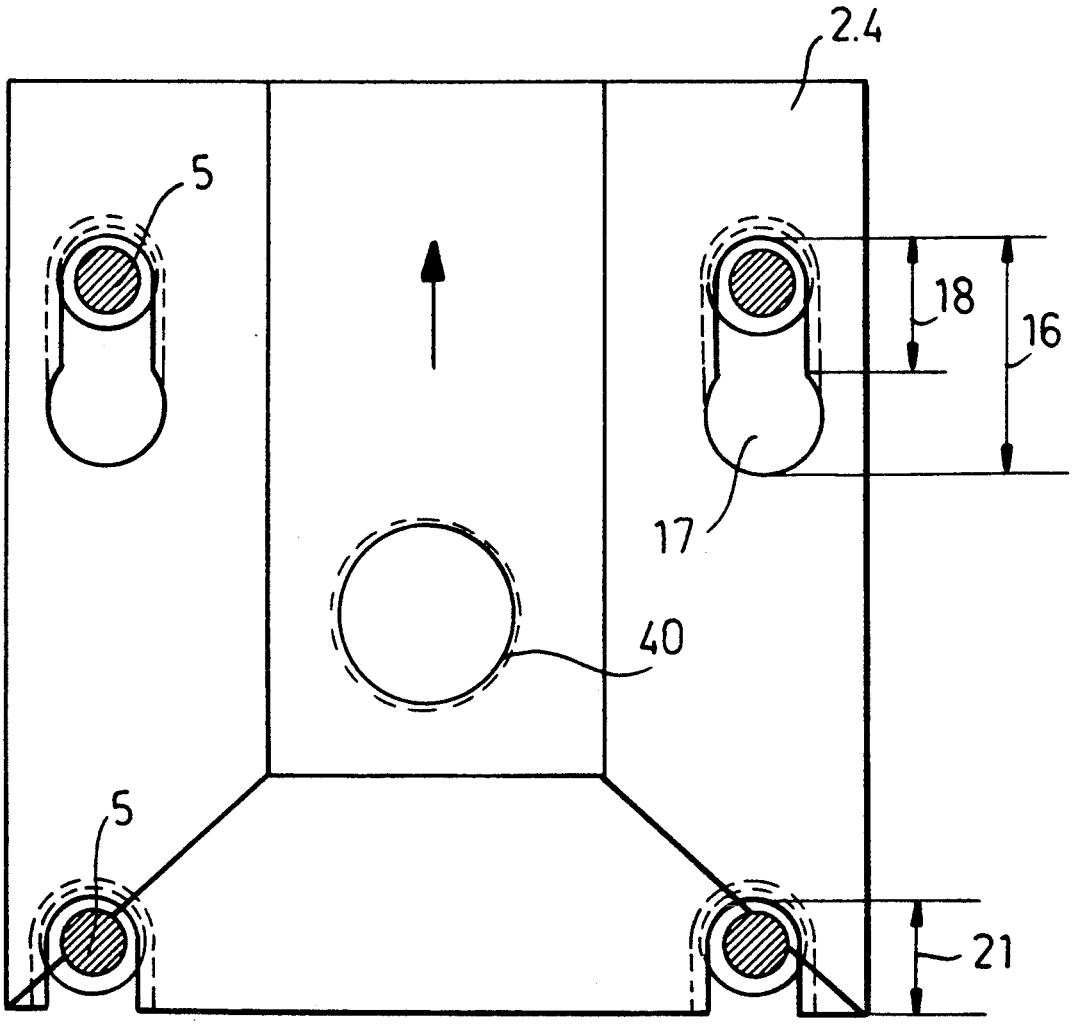

FIG. 9 shows a similar plate 2.4, but here the holes 15 are parallel to each other and are aligned with narrow-width slots 21. This plate 2.4 is removed by knocking it transversely as shown by the arrow, thereby aligning two of the rods 5 with the wide parts 17 of the respective holes 16 while pulling the other two rods 5 completely out of the respective slots 21.

Figure 10:
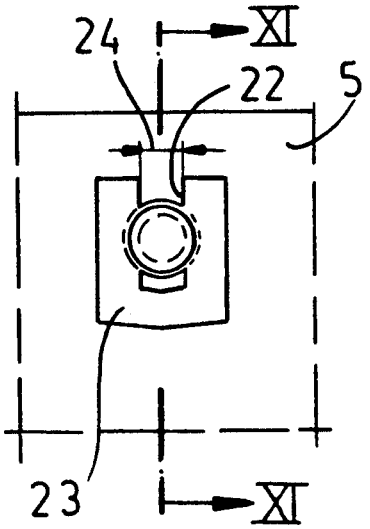
Figure 11:
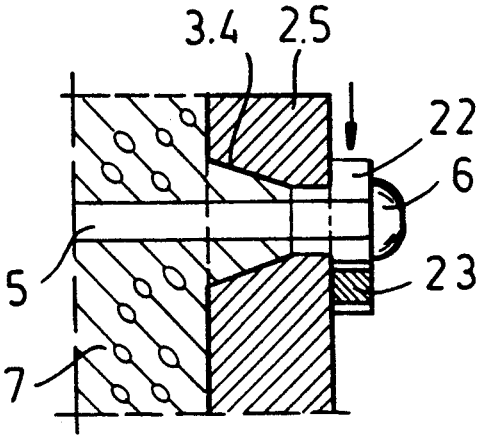
FIG. 11 is a section taken along line XI—XI of FIG. 10.

The plate 2.5 of FIGS. 10 and 11 has holes 3.4 that each have an inwardly flaring frustoconical inner portion and coaxial therewith a cylindrical outer portion of an inner diameter slightly greater than the outside diameter of the respective head 6. In this arrangement a U-shaped clip 23 that has a notch or cutout 22 of a width 22 equal to slightly more than the diameter of the rod 5 and substantially less than that of the head 6 is slipped between the head 6 and the outer face of the plate 2.5. Thus to release the head 6 it is merely necessary to knock the clip 23 out transversely, then pull the plate 2.5 longitudinally outward.

Figure 12:
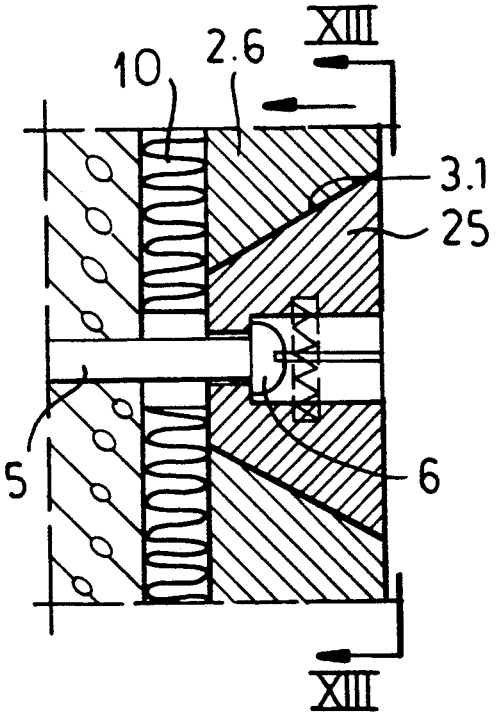
FIG. 12 is a view like FIG. 11 of another system according to the present invention.
Figure 13:
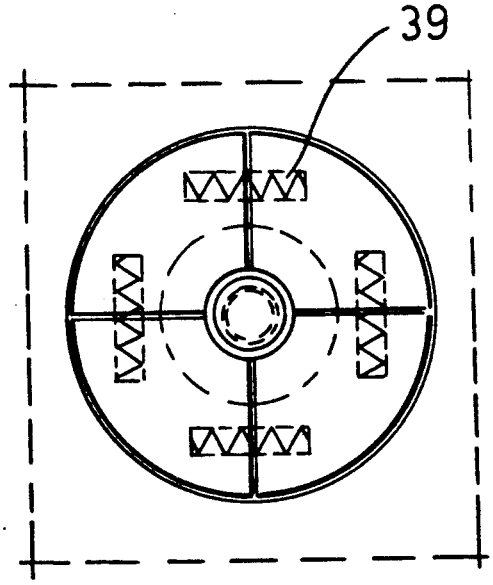
FIG. 13 is an end view taken along line XIII—XIII of FIG. 12.

In FIGS. 12 and 13 a plate 2.6 has frustoconical outwardly flared holes 3.1 of a small-end diameter that is much greater than the outside diameter of the respective rod head 6. A four-part plug 25 fits complementarily in the frustoconical hole 3.1 and engages under the respective head 6. This plug 25 is formed by four identical segments that are urged angularly apart by springs 39. Thus to free the rod head 6 it is necessary to press the plate 2.6 longitudinally inward so that the rod head 6 moves outward, permitting the springs 39 to spread the segments of the plug 25 until they clear the head 6. The plug 25 is then removed and the plate 2.6 can be pulled off.

Figure 14:
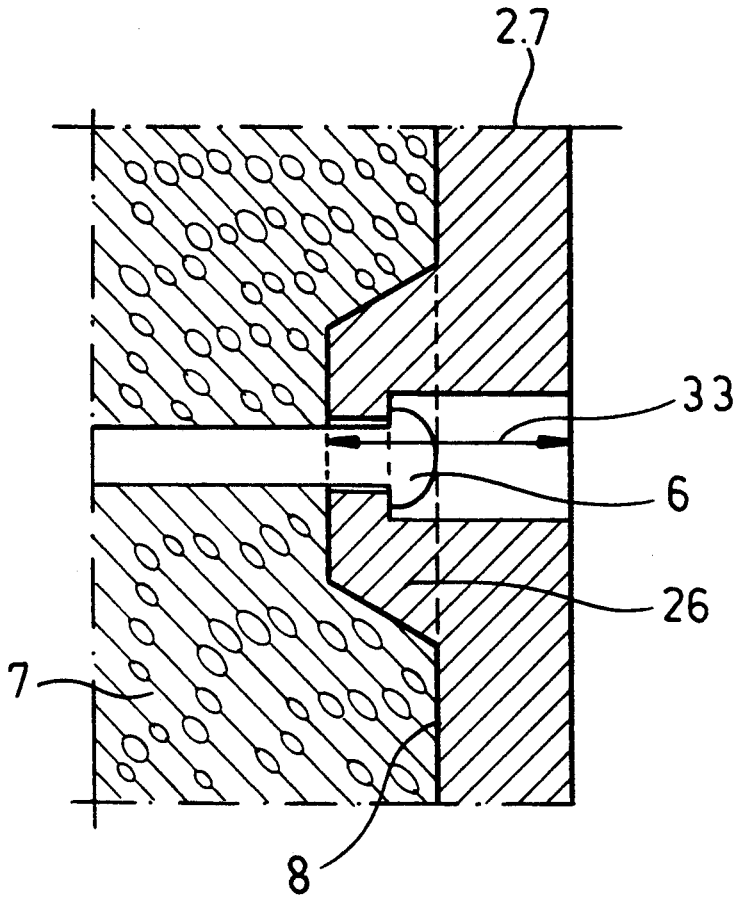
FIGS. 14, 15, and 16 are longitudinal sections through three more systems in accordance with the present invention.

In order to ensure that the ends of the rods 5 do not project past the ends of the mass 7, FIG. 14 shows a plate 2.6 with an inwardly projecting boss 26 at each hole 3.3 which can therefore be a counterbore that recesses the head 6 to a level below the end face of the mass 7. Thus when the head 6 is removed, for instance by machining, the resultant stub of the rod 5 will not project past the end of the beam.

Figure 15:
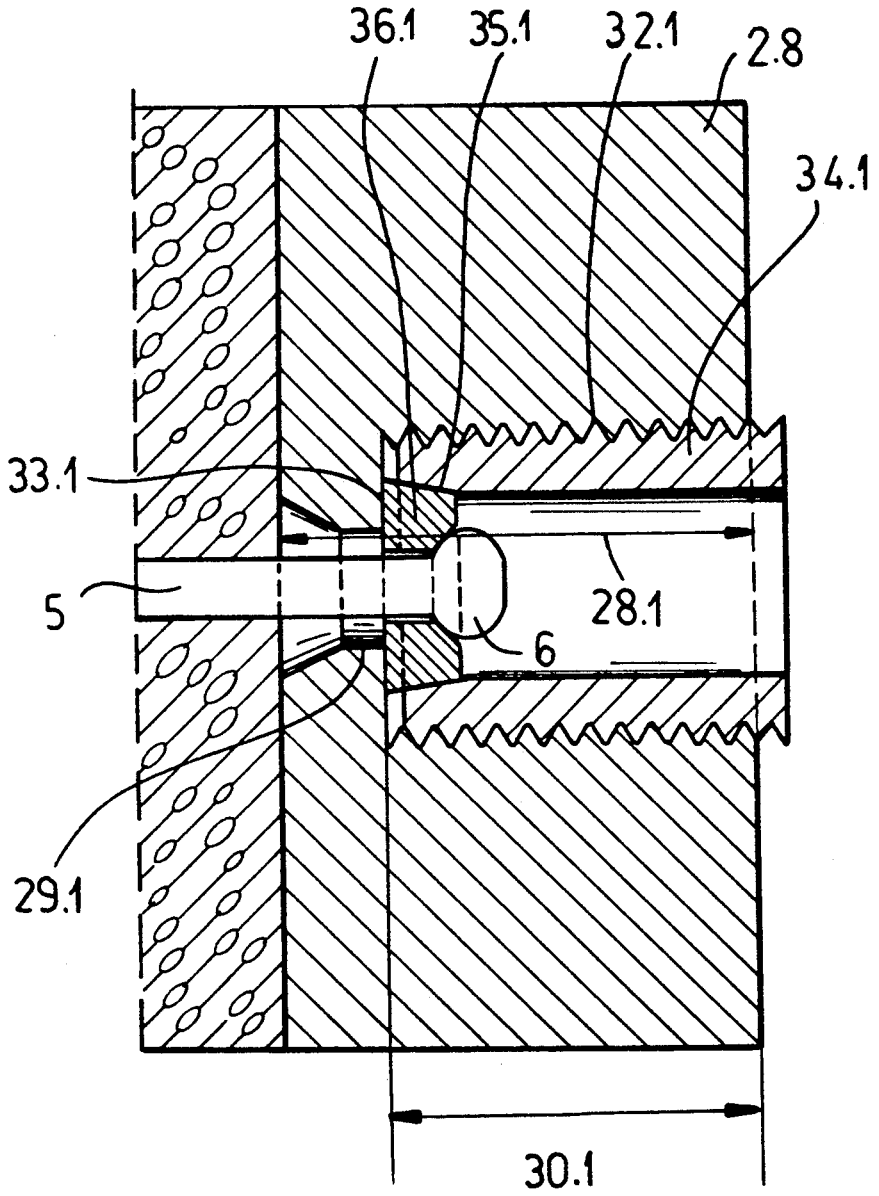

FIG. 15 shows a plate 2.8 formed with a hole 28.1 having an inner portion 29.1 of roughly the same size and shape as the hole 3.4 of FIGS. 10 and 11 and a cylindrical outer portion 30.1 which is of a substantially greater diameter and is formed with a internal screwthread 32.1. An externally threaded sleeve 34.1 can be screwed into the outer portion 30.1 and has an internal inwardly flared seat 35.1 that can press the segments of a multipart plug 36.1 radially inward. This plug 36.1 is therefore braced against a shoulder 33.1 defining the inner end of the outer portion 30.1 and the seat 35.1 to engage under the head 6 of the respective rod 5. When the sleeve 34.1 is unscrewed, the segments of the head 36.1 will spread to allow the head 6 to pass inward through the inner portion 29.1 of the hole 28.1.

Figure 16:
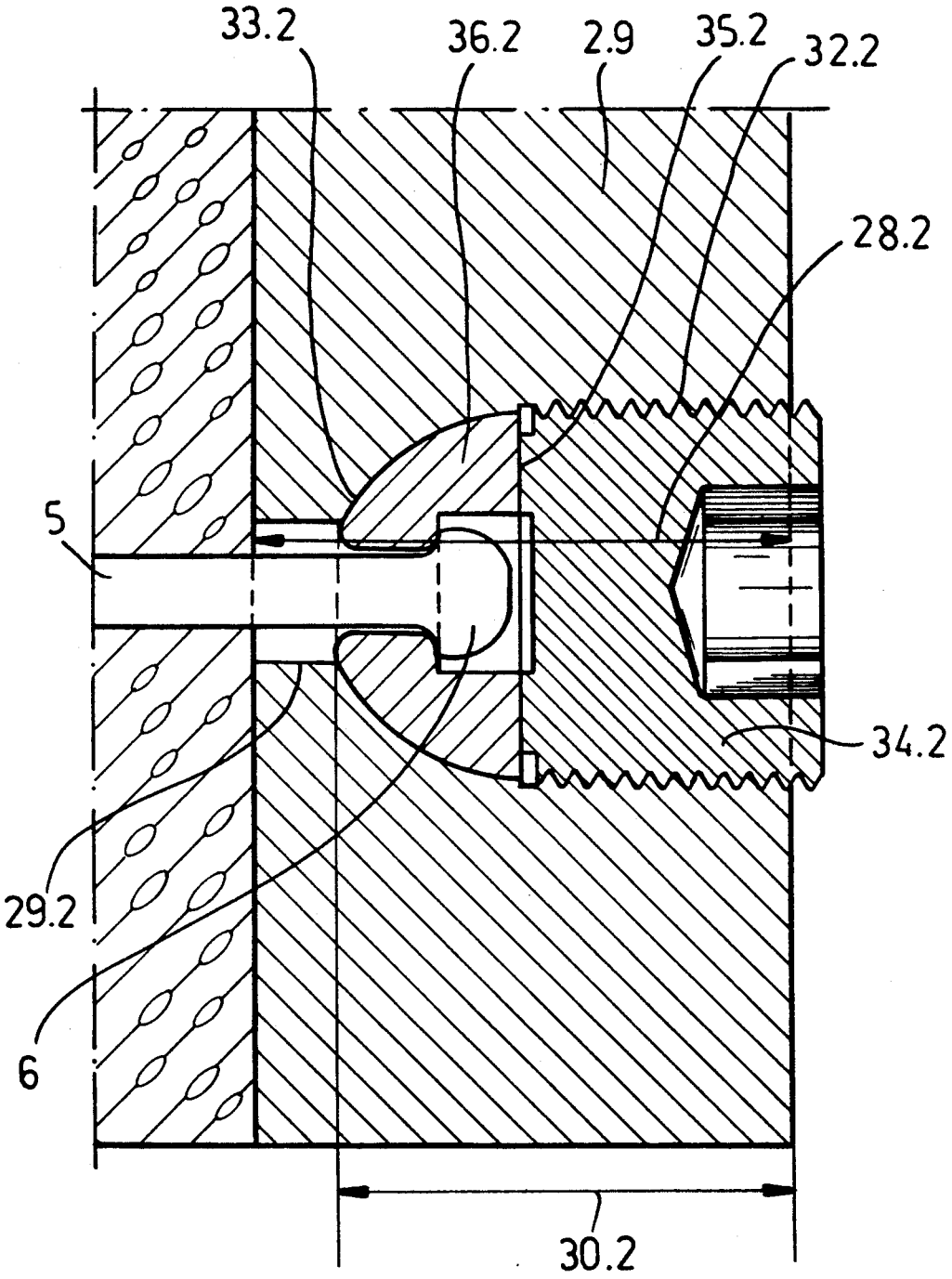

A similar system is seen in FIG. 16 where structure functionally identical to that of FIG. 15 bears the same reference numeral but with a "0.2" rather than the "0.1" of FIG. 15. Here, however, the front surface 33.2 is of part-spherical shape and the segments of the plug 36.2 are of complementary shape. The packing plug 34.2 is not tubular and has an end face 35.2 that presses the segments of the plug 36.2. Otherwise this arrangement functions identically to that of FIG. 15.

Figure 17:
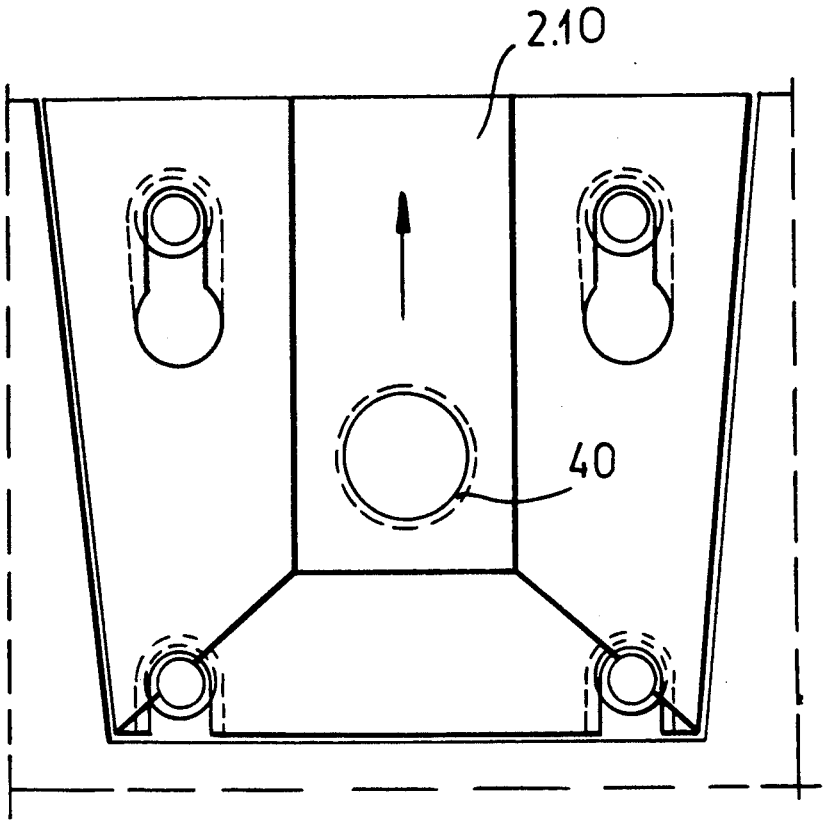
FIG. 17 is an end view of another end plate according to the invention with the rods shown in section.
Figure 18:
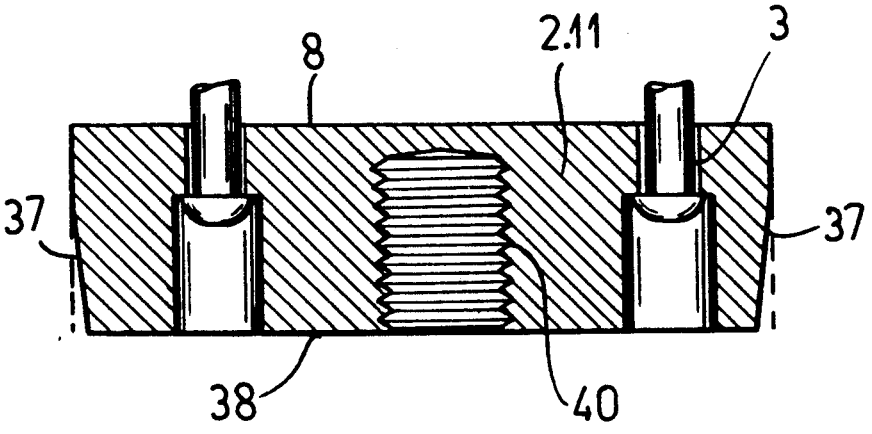
FIGS. 18 and 19 are cross sections through further end plates.

FIG. 17 shows a plate 2.10 substantially identical to that of FIG. 9, except that it is of right-trapezoidal shape and FIG. 18 shows another such plate 2.11 that has edges 37 that are chamfered somewhat toward the outer face so that seen from the top it also is of trapezoidal shape. Such shaping prevents the plate from getting wedged in the mold 1.

Figure 19:
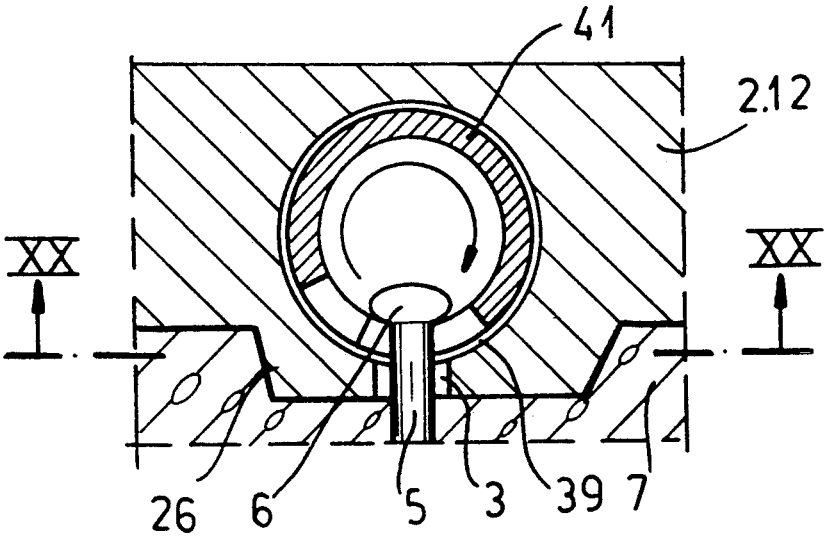
Figure 20:
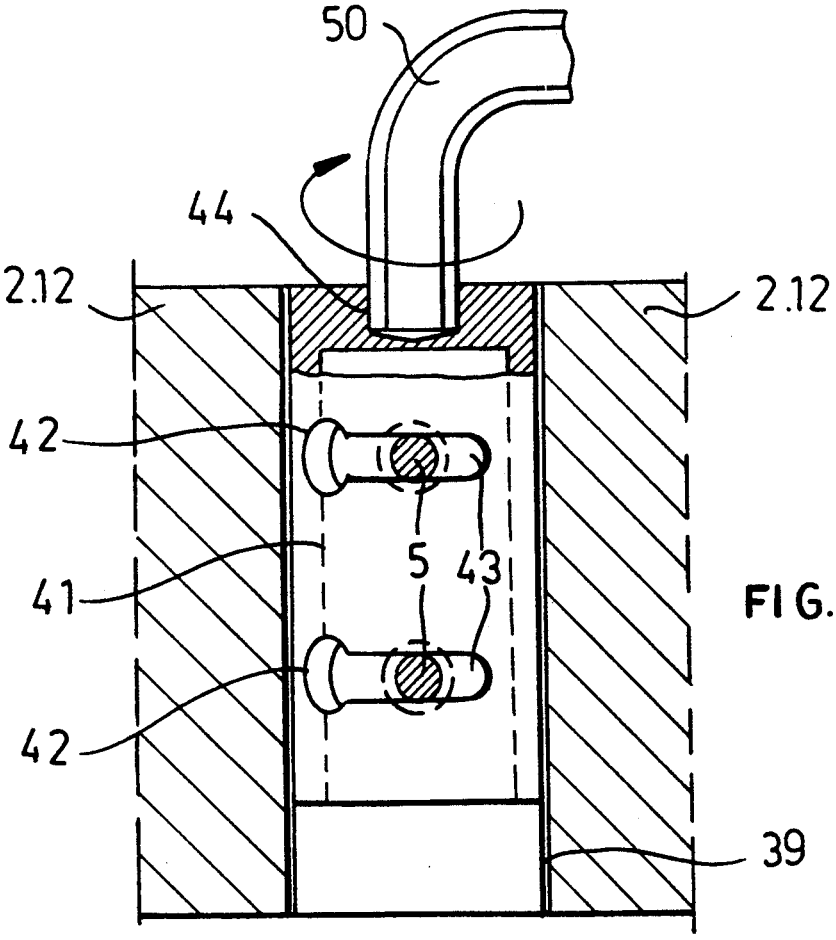
FIG. 20 is a section taken along line XX—XX of FIG. 19.

The system of FIGS. 19 and 20 has a plate 2.12 formed with projections 26 as described above and with a transverse passage 39 into which the holes 3 open. A tubular locking element 41 is formed with keyhole-shaped holes having wide parts 42 and narrow parts 43 and is formed at one end with a blind hex socket 44 for receiving an allen wrench 50. It is therefore possible to capture the heads 6 in the narrow parts 43 of the tube 41 by rotation of this tube 41 and to release them by reverse rotating it. The plate 2.12 and tube 41 are therefore a reusable assembly.

Figure 21:
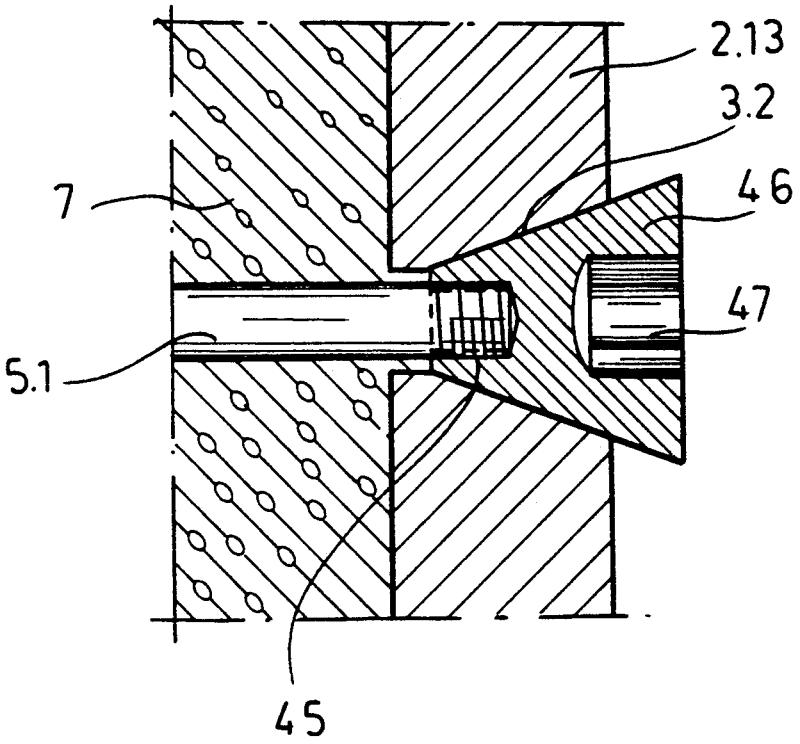
FIG. 21 is a section through yet another system in accordance with the present invention.

Finally, FIG. 21 shows a plate 2.13 used with a rod 5.1 having a threaded end 45 . The plate 2.13 has an outwardly flaring frustoconical hole 3.2 and the head of the rod 5.1 is formed by a frustoconical plug 46 complementary to the hole 3.2. A hex recess 47 in the outer end of the plug 46 on the axis thereof allows a wrench such as seen in FIG. 20 to be used to unscrew it. Thus in this case the plug 46 can be unscrewed from the threaded rod end 45 to allow the plate 2.13 to be removed.

I claim:

1. A system for making a prestressed concrete beam, the system comprising:

a longitudinally extending mold having end walls having inner faces;

respective rigid end plates juxtaposed with the inner faces of the mold end walls, each formed with at least one longitudinally throughgoing hole, and having longitudinally outwardly directed outer faces;

at least one longitudinally extending reinforcing rod extending longitudinally in the mold and having opposite ends projecting longitudinally outward through the respective holes in the end plates, the rods being provided longitudinally outward of the outer faces with respective laterally projecting heads, the holes in the end plates being wide enough that the rod heads can pass longitudinally through them;

respective latching elements each forming a cutout snugly engageable around the respective rod between the outer face of the respective plate and the respective head, whereby the latching elements brace the rod heads longitudinally inward against the plate outer faces; and means for applying longitudinally opposite outward traction to the end plates to tension the rods, whereby when the rods are tensioned a mass of concrete can be filled into the mold around the rods and between the plates and this mass can be cured, the elements being laterally removable from between the rod heads and the respective end plates after curing of the concrete to allow the plates to be separated from the rods.

2. The system defined in claim 1 wherein the element is formed with a keyhole-shaped hole forming the cutout.

3. The system defined in claim 1 wherein each plate is of trapezoidal shape.

4. A system for making a prestressed concrete beam, the system comprising:

a longitudinally extending mold having end walls having inner faces;

respective rigid end plates juxtaposed with the inner faces of the mold end walls, each formed with at least one longitudinally throughgoing hole, and having longitudinally outwardly directed outer faces, each plate further being formed with at least one passage into which the respective hole opens;

at least one longitudinally extending reinforcing rod extending longitudinally in the mold and having opposite ends projecting longitudinally outward through the respective holes in the end plates, the rods being provided in the passages with respective laterally projecting heads, the holes in the end plates being wide enough that the rod heads can pass longitudinally through them;

a respective tube rotatable in each passage and formed with a keyhole-shaped hole forming a cutout through which the respective head can engage to trap same in the passage, the cutout being snugly engageable around the respective rod between the outer face of the respective plate and the respective head, whereby the tubes brace the rod heads longitudinally inward against the plate outer faces; and means for applying longitudinally opposite outward traction to the end plates to tension the rods, whereby when the rods are tensioned a mass of concrete can be filled into the mold around the rods and between the plates and this mass can be cured, the tubes being laterally removable from between the rod heads and the respective ned plates after curing of the concrete to allow the plates to be separated from the rods.

* * * * *